US005109207A

United States Patent [19]

Aizawa et al.

[11] Patent Number: 5,109,207

[45] Date of Patent: Apr. 28, 1992

[54] COAXIAL DIELECTRIC RESONATOR HAVING A GROOVE THEREIN AND METHOD OF PRODUCING SUCH COAXIAL DIELECTRIC RESONATOR

[75] Inventors: Kimio Aizawa, Ikoma; Masaki Kita, Kyoto, both of Japan

[73] Assignee: Matsushita Electric Industrial Co., Ltd., Osaka, Japan

[21] Appl. No.: 621,812

[22] Filed: Dec. 4, 1990

[30] Foreign Application Priority Data

Dec. 19, 1989 [JP] Japan ..... 1-330735

[51] Int. Cl.[5] ..... H01P 7/04; H01P 1/202

[52] U.S. Cl. ..... 333/222; 333/206

[58] Field of Search ..... 333/202, 206, 207, 219, 333/219.1, 222, 223; 29/600; 204/38.4; 427/126.2

[56] References Cited

U.S. PATENT DOCUMENTS 4,223,287 9/1980 Nishikawa et al. ..... 333/223 X
4,398,164 8/1983 Nishikawa et al. ..... 333/222
4,806,889 2/1989 Nakano et al. ..... 333/202

FOREIGN PATENT DOCUMENTS 0079501 3/1990 Japan ..... 333/202

*Primary Examiner*—Eugene R. Laroche
*Assistant Examiner*—Seung Ham
*Attorney, Agent, or Firm*—Stevens, Davis, Miller & Mosher

[57] ABSTRACT

A dielectric resonator includes a resonator body having a groove formed in its upper surface adjacent to an outer periphery of a through hole formed through the body. An electrically-conductive film on the inner surface of the groove is electrically connected to an electrically-conductive film formed on the inner peripheral surface of the through hole, via an electrically-conductive film formed on a portion of the upper surface of the body lying between the groove and the through hole. The groove having the electrically-conductive film formed on its inner surface enables the length of the body to be reduced and the overall resonator to have a reduced size.

20 Claims, 8 Drawing Sheets

COAXIAL DIELECTRIC RESONATOR HAVING A GROOVE THEREIN AND METHOD OF PRODUCING SUCH COAXIAL DIELECTRIC RESONATOR

BACKGROUND OF THE INVENTION

This invention relates to a dielectric resonator for use, for example, in a filter device of high-frequency radio (wireless) equipment, and also to a method of producing such a dielectric resonator.

A conventional dielectric resonator designed to have a reduced length is shown in FIGS. 17 and 18. FIG. 17 is a perspective view of this dielectric resonator, and FIG. 18 is a cross-sectional view taken along the line XVIII—XVIII of FIG. 17. More specifically, a dielectric body 1 of a pillar-like or columnar shape has a through hole 4 extending from an upper surface 2 to a lower surface 3, and an outer peripheral surface of the body 1 has a stepped shape. An electrically-conductive film 5 is formed on the entire surface of the body 1 except for the upper surface 2, thus providing a dielectric resonator 6.

In order to obtain a predetermined resonance frequency with respect to a conventional dielectric resonator of the above coaxial type, it is necessary that the length of an electrically-conductive film on the outer peripheral surface of a dielectric body, as well as the length of the electirically-conductive film on the inner peripheral surface of a through hole formed through the body, should be greater than a predetermined length. For this reason, it has been difficult to shorten the length of the body.

To overcome this difficulty, there has been proposed the dielectric resonator of FIGS. 17 and 18 in which the outer peripheral surface of the body 1 is stepped so as to be increased in length, so that the length of the electrically-conductive film 5 on the outer peripheral surface of the body 1 can be increased. By doing so, the length of the electrically-conductive film 5 is not shortened despite the reduced length of the body 1. Thus, the length of the body 1 can be shortened.

The following requirements must be met in order to further shorten the length of the body 1 of the dielectric resonator shown in FIGS. 17 and 18.

First, referring to reference characters in FIG. 18, l1 represents the length of the lower portion of the body 1, and l2 represents the length of the upper portion of the body 1 (the upper and lower portions of the body 1 are separated from each other by the step portion on the outer peripheral surface of the body 1) also, lt represents the overall length of the body 1, and al represents the radius of the through hole 4. In addition, b1 represents the radius of the lower portion of the body 1, and b2 represents the radius of the upper portion of the body 1.

In order to further reduce the length lt of the body 1 of the dielectric resonator shown FIGS. 17 and 18, $l1=l2$ must be satisfied, and besides the impedance ratio K ($K=\ln(b2/a1)/\ln(b1/a1)$) must be reduced. However, in order to reduce the impedance ratio K, it is necessary either to increase a1 or to decrease b2, in which case the volume of the body 1 is reduced. This results in a problem that the selectivity of the no-load (Q) is lowered.

SUMMARY OF THE INVENTION

It is therefore an object of this invention to provide a dielectric resonator which can be reduced in overall length without unduly lowering the selectivity of the no-load (Q).

According to the present invention, there is provided a dielectric resonator in which a groove is formed in an upper surface of a resonator body adjacent to an outer periphery of a through hole formed through the body, and an electrically-conductive film formed on the inner surface of the groove is electrically connected to an electrically-conductive film, formed on the inner peripheral surface of the through hole, via an electrically-conductive film formed on that portion of the upper surface of the body lying between the groove and the through hole.

With this construction, the electrically-conductive film in the through hole is extended to the electrically-conductive film formed on the upper surface of the body and the inner surface of the groove. In this case, the electrically-conductive film is formed on the bottom surface of the groove and the opposed upstanding side walls of the groove interconnected by this bottom surface, and therefore the electrically-conductive film can be made longer than that formed on the stepped outer peripheral surface of the body of the conventional dielectric resonator. Accordingly, the body of the dielectric resonator of the present invention can be made shorter.

The groove does not need to have a large width, and therefore the volume of the body is not decreased so mush, so that the reduction of the selectivity of the no-load can be restrained.

DETAILED DESCRIPTION OF THE PREFERRED EMBODIMENTS

Preferred embodiments of the invention will now be described with reference to the drawings.

Figure 1:
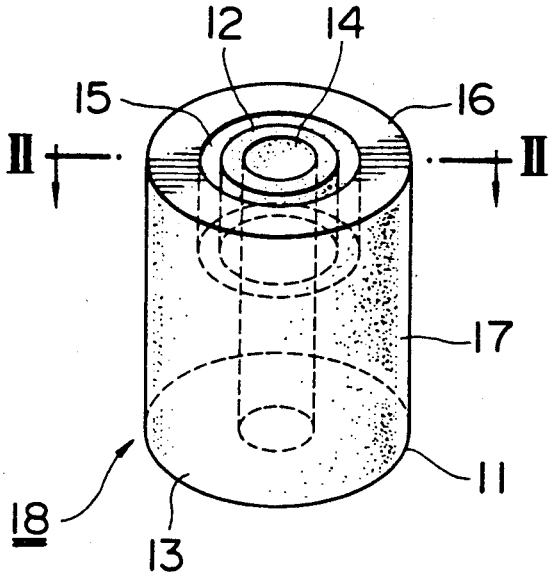
FIG. 1 is a perspective view of a first embodiment of a dielectric resonator of the present invention.
Figure 2:
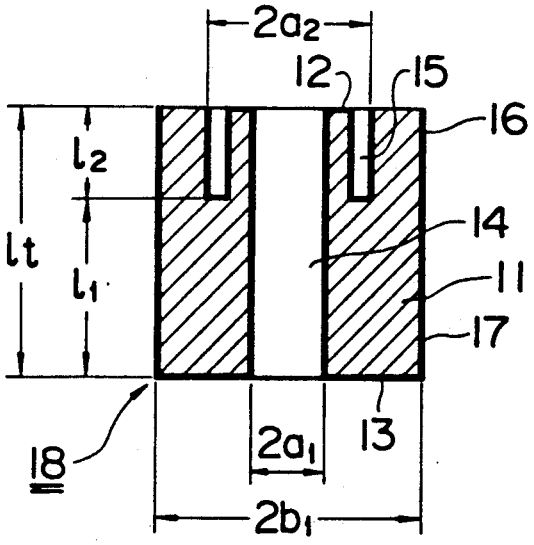
FIG. 2 is a cross-sectional view taken along the line II—II of FIG. 1.

FIGS. 1 and 2 shows a λ/4-type dielectric resonator 18 according to a first embodiment of the invention. FIG. 1 is a perspective view of the dielectric resonator 18, and FIG. 2 is a cross-sectional view taken along the line II—II of FIG. 1. A body 11 of the dielectric resonator 18 is made of barium titanate-type dielectric ceramics. The body 11 has a cylindrical shape, and has a through hole 14 extending from an upper surface 12 to a lower surface 13 along the axis thereof. An annular groove 15 having a predetermined width and a predetermined depth is formed in the upper surface 12 of the body 11, and is disposed in surrounding relation to the through hole 14.

An electrically-conductive film 17 of copper or silver is formed by plating, metallizing or the like on the entire surface of the body 11 (including the inner peripheral surface of the through hole 14 and the surface of the groove 15) except for that portion 16 of the upper surface 12 lying between the groove 15 and the outer periphery of the body 11.

In FIG. 2, lt represents the length of the body 11, and l1 represents the length of that portion of the body 11 extending between the bottom of the groove 15 and the lower surface 13. Also, l2 represents the length (depth) of the groove 15, and a1 represents the radius of the through hole 14. In addition a2 represents the radius of the groove 15 extending from its centerline thereof and its outer periphery, and b1 represents the radius of the body 11.

In the dielectric resonator 18 of the above construction, the groove 15 is formed, and the electrically-conductive film 17 is formed on the bottom surface of the groove 15 and the opposed upstanding side walls of the groove 15 interconnected by this bottom surface, and this electrically-conductive film 17 is continuous with the electrically-conductive films 17 formed respectively on the inner peripheral surface of the through hole 14 and the upper surface 12. Therefore, the electrically-conducive film 17 in the through hole 14 can be regarded as being increased. Therefore, the overall length lt of the body 11 can be shortened. For the purpose of further reducing the overall length lt of the body 11, even if the value of a2 is increased so as to reduce the impedance ratio $K_1$ ($K_1 = ln(b1/a2)/ln(b1/a1)$) or $K_2$ ($K_2 = ln(b1/a1)/ln(a2/a1)$) available when this resonator is regarded as a coaxial line, the volume of the body 11 is not reduced so much, because the width of the groove 15 is narrow, and hence the amount of removal of the material from the body 11 is small. Therefore, the dielectric resonator of the present invention can be higher in the selectivity of the no-load (Q) than the conventional dielectric resonators.

Figure 3:
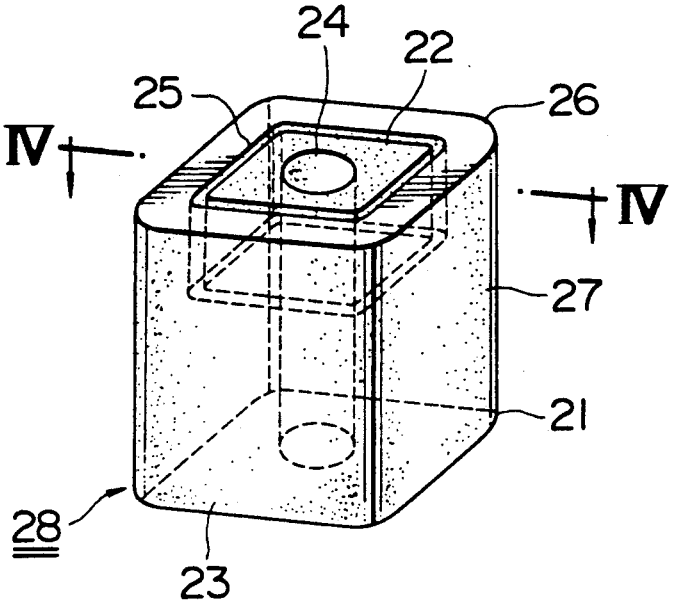
FIG. 3 is a perspective view of a second embodiment of a dielectric resonator of the present invention.
Figure 4:
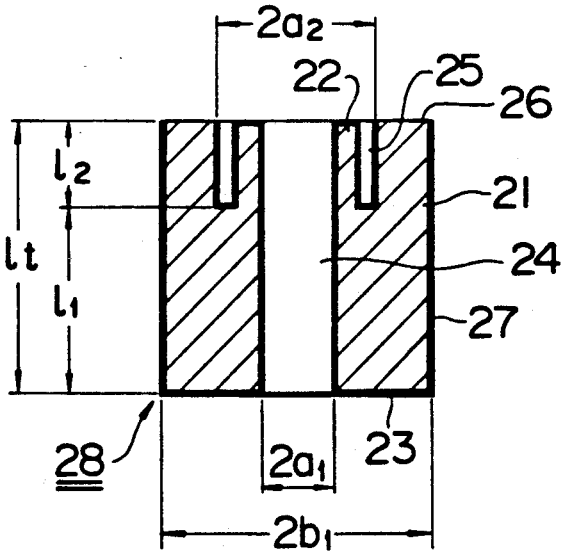
FIG. 4 is a cross-sectional view taken along the line IV—IV of FIG. 3.

FIGS. 3 and 4 show a λ/4-type dielectric resonator 28 according to a second embodiment of the invention. FIG. 3 is a perspective view of the dielectric resonator 28, and FIG. 4 is a cross-sectional view taken along the line IV—IV of FIG. 3.

A body 21 of the dielectric resonator 28 has a square pillar-shape. The body 21 has a through hole 24 extending from an upper surface 22 to a lower surface 23 along the axis thereof. An annular or square groove 25 having a predetermined width and a predetermined depth is formed in the upper surface 22 in surrounding relation to the through hole 24.

An electrically-conductive film 27 is formed on the entire surface of the body 21 except for that portion 26 of the upper surface 22 lying between the groove 25 and the outer periphery of the body 21. When the depth l2 of the groove 25 is about 20% to about 30% of the overall length lt of the body 21, better effects can be achieved in view of both the rate of reduction of the overall length lt and the selectivity of the no-load (Q).

The dielectric resonator 28 of the above construction has effects the same as those achieved with the first embodiment of FIGS. 1 and 2, and in addition since the dielectric resonator 28 has a square columnar or pillar-shape, a better volume efficiency can be achieved when a plurality of dielectric resonators 28 are connected together laterally in a multi-stage manner to provide a filter. Namely, in this construction, the selectivity of the no-load (Q) can be higher with the transverse dimension equal to the diameter of the dielectric resonator of the first embodiment.

Figure 5:
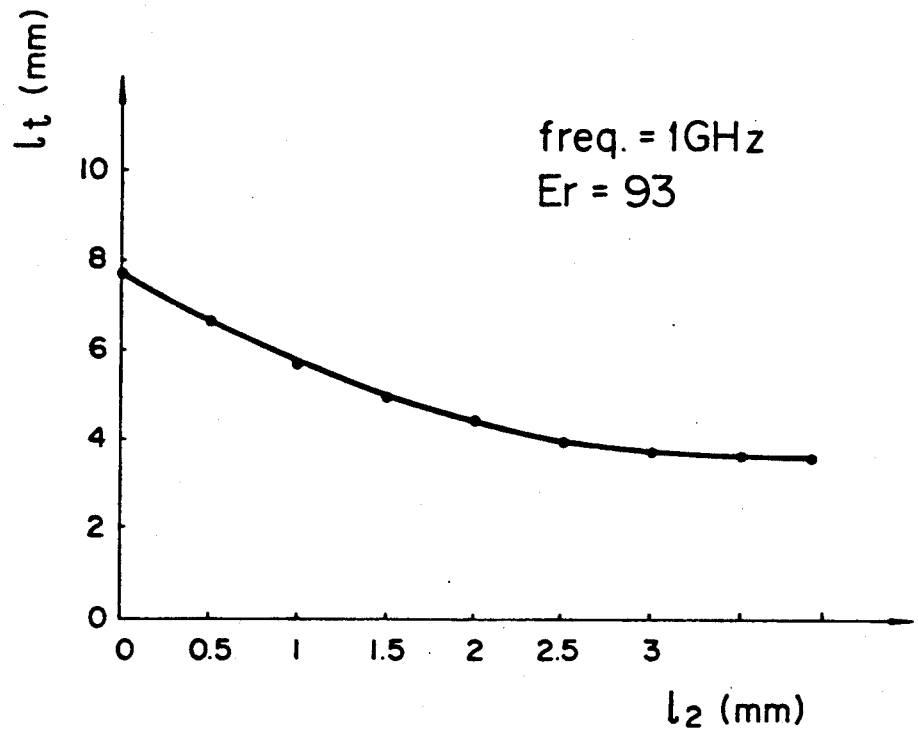
FIGS. 5 and 6 are diagrammatical illustrations showing characteristics of the dielectric resonator of FIG. 3.
Figure 6:
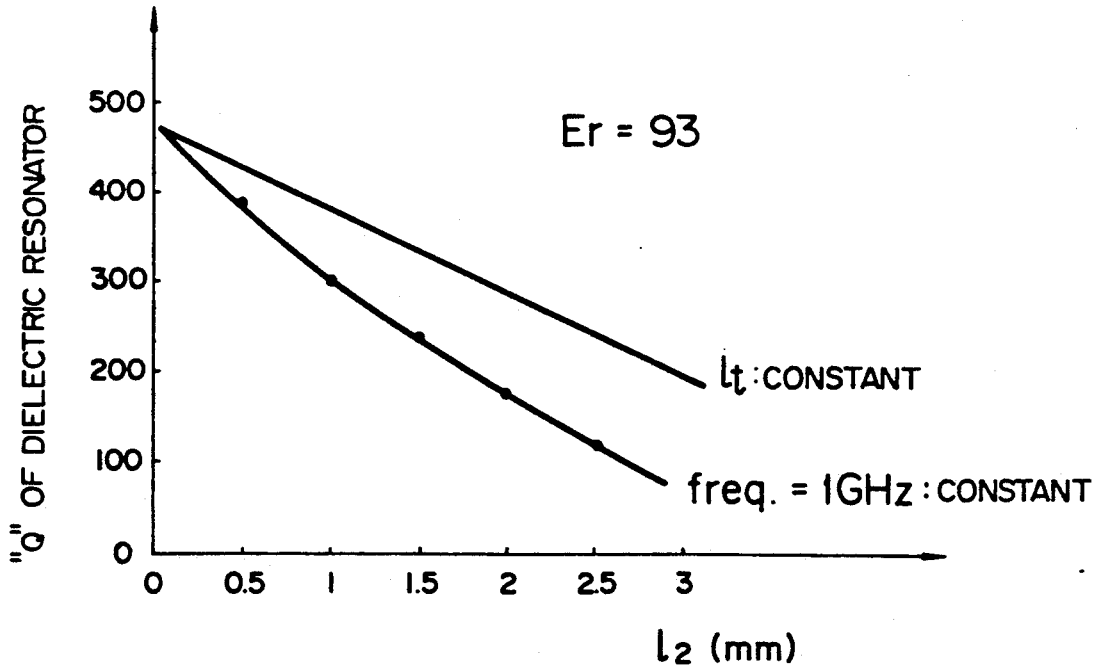

FIGS. 5 and 6 show examples of measured data of the dielectric resonator 28 of FIGS. 3 and 4. More specifically, FIG. 5 is a graph illustrating the relation between the depth l2 of the groove 25 and the overall length lt of the body 21 at a constant resonance frequency of the dielectric resonator 28. FIG. 6 is a graph illustrating the relations between the depth l2 of the groove 25 and the selectivity of the no-load Q of the dielectric resonator 28 obtained respectively when the overall length lt of the body 21 is constant and when the resonance frequency is constant. For example, when the depth l2 of the groove 25 is 1.1 mm (about 20% of the overall length lt of the body 21) at the resonance frequency of 1 GHz as shown in FIG. 5, the overall length lt of the resonator is reduced about 27%. In this case, as can be seen from FIG. 6, the selectivity of the no-load (Q) can be sufficiently high, and therefore there is no problem. Thus, in view of the reduction rate of the overall length lt and the selectivity of the no-load (Q), it is most preferred that the depth l2 of the groove 25 should be about 20% to about 30% of the overall length lt in order to achieve the maximum effects. If this percentage is more than 30%, the effect of the reduction rate of the overall length lt is saturated, and in addition resonance of unnecessary modes is liable to occur.

In the dielectric resonators of the present invention, since the overall length of the body 11, 21 is reduced mainly by adjusting the depth of the groove 15, 25, the dielectric resonators of the present invention are not changed in external shape, and therefore can be easily formed by pressing, because they have no such stepped portion as provided on the conventional dielectric resonator.

Figure 7:
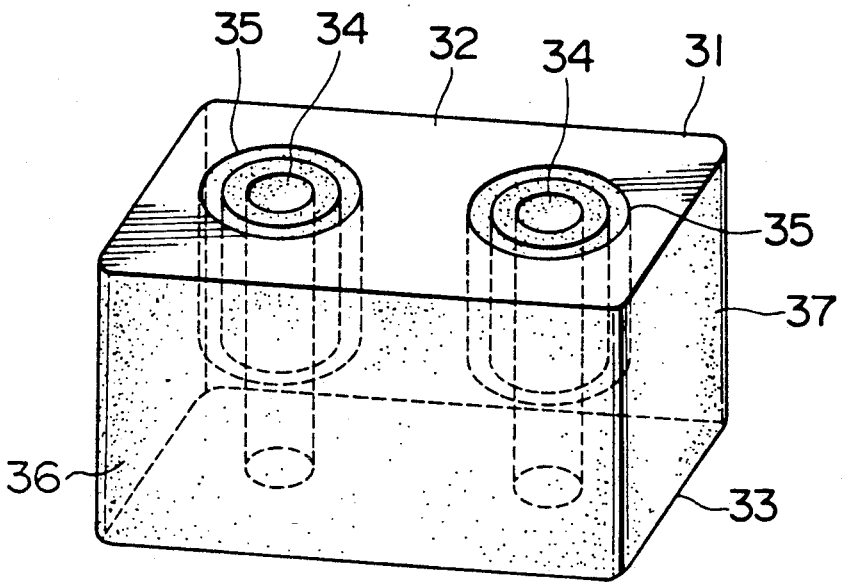
FIG. 7 is a perspective view of a third embodiment of a dielectric resonator of the present invention.

FIG. 7 shows a third embodiment of the invention. In this embodiment, two through holes 34 and 34 are formed through a body 31 of a rectangular columnar or pillar-shape and extend from an upper surface 32 and a lower surface 33 of the body 31. Two annular grooves 35 and 35 are formed in the upper surface 32, and are disposed in surrounding relation to the two through holes 34 and 34, respectively.

An electrically-conductive film 37 is formed on an outer peripheral surface 36 of the body 31, the lower surface 33 of the body 31, the inner peripheral surfaces of the through holes 34, the inner surfaces of the grooves 35, and those portions of the upper surface 32 each lying between a respective one of through holes 34 and a corresponding one of grooves 35 disposed thereabout, thus providing a dielectric resonator 38.

Figure 8:
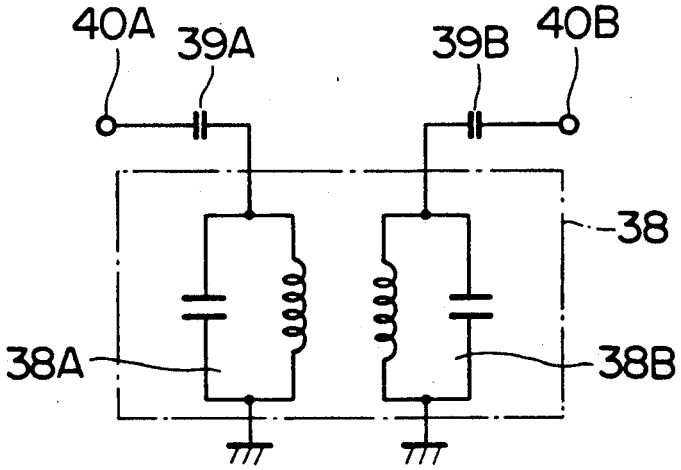
FIG. 8 is a circuit diagram of an equivalent circuit of the dielectric resonator of FIG. 7.

An electrical equivalent circuit of the construction of FIG. 7 is shown in FIG. 8, and dielectric resonators 38A and 38B constituted respectively by the through hole portions 34 are magnetic field-coupled together. Coupling capacitors 39A and 39B are provided for forming a filter device. Reference numerals 40A and 40B denote an input terminal and an output terminal, respectively.

Figure 9:
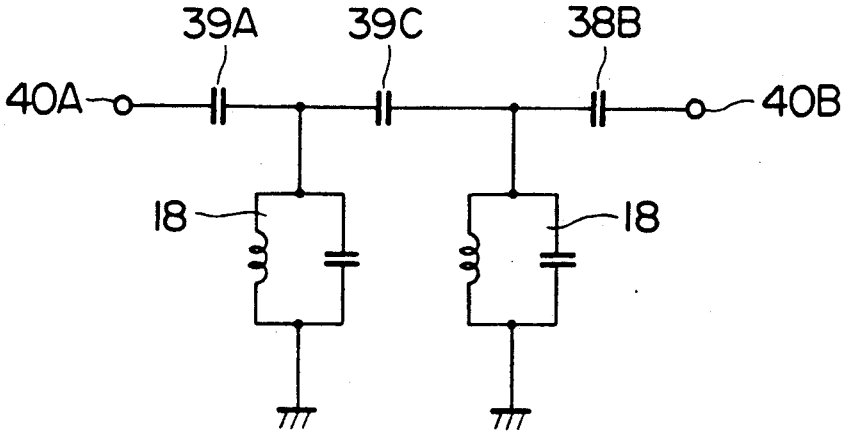
FIG. 9 is a circuit diagram of a filter device constituted by two dielectric resonators of FIG. 1.

FIG. 9 shows an equivalent circuit of a filter device comprising two dielectric resonators each having only one through hole 14 as shown in FIG. 1. In this case, a coupling capacitor 39C is needed for coupling the two dielectric resonators together, and thus the two dielectric resonators 18 are capacity-coupled together.

Figure 10:
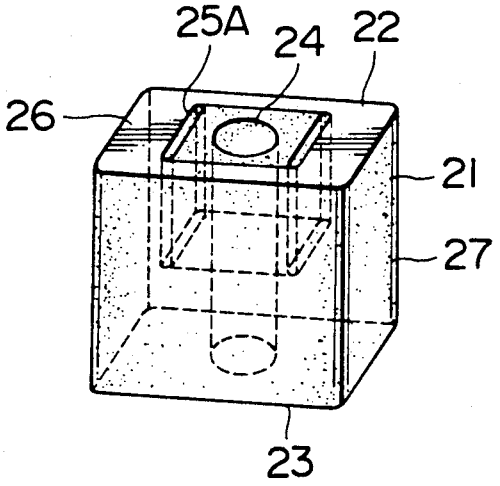
FIGS. 10 and 11 are perspective views of modified dielectric resonators of the invention, respectively.
Figure 11:
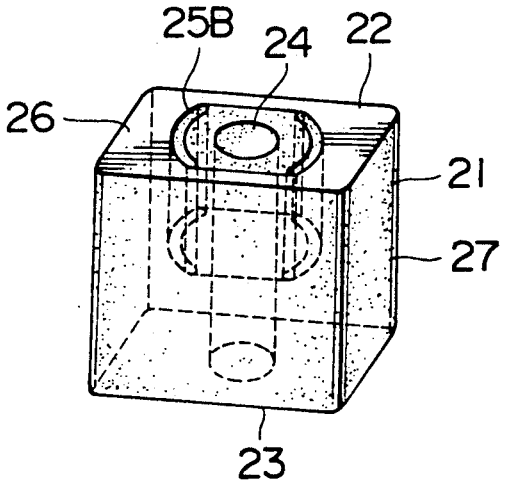
Figure 12:
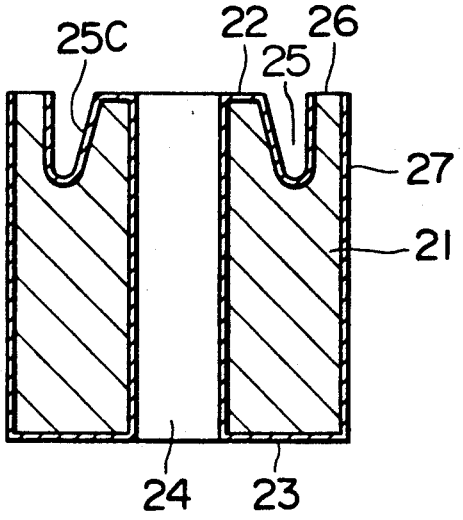
FIG. 12 is a cross-sectional view of a further modified dielectric resonator of the invention.

FIGS. 10 to 12 show modified forms of the dielectric resonator 28 of FIG. 3, respectively, in which the groove 25 is modified in shape. More specifically, in the construction shown in FIG. 10, two straight grooves 25A are provided respectively on opposite sides of a through hole 24. In the construction shown in FIG. 11, two grooves 25B of an arcuate cross-section are provided respectively on opposite sides of a through hole 24. In the construction shown in FIG. 12, an inner side surface or wall 25C of an annular groove 25 disposed close to a through hole 24 is inclined upwardly toward the through hole 24 and the bottom surface thereof is concavely curved. In this case, the upper opening of the groove 25 is enlarged, and therefore this construction facilitates the release or removal of a mold used for a compression molding of a body 21. This construction of FIG. 12 causes less variations in resonance frequency as compared with the case where the outer side surface or wall of the annular groove 25 is inclined in a direction away from the through hole 24.

Figure 13:
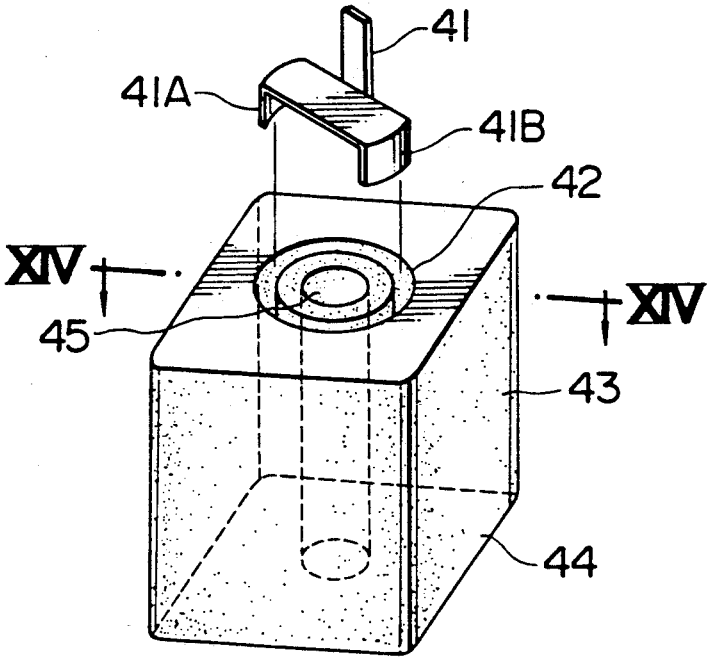
FIG. 13 is a perspective view of a further modified dielectric resonator of the invention.
Figure 14:
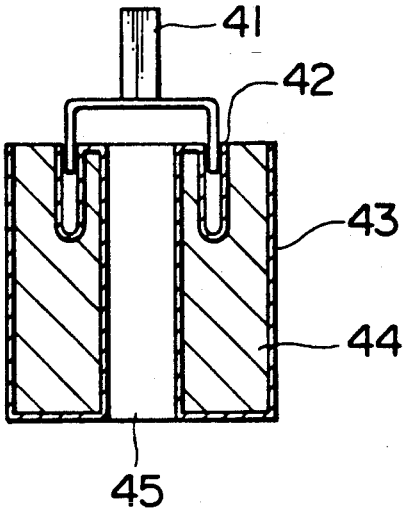
FIG. 14 is a cross-sectional view taken along the line XIV—XIV of FIG. 13.

FIGS. 13 and 14 show a method of connection of a lead terminal 41. Two legs 41A and 41B of the terminal 41 are inserted in an annular groove 42, and are electrically and mechanically connected by soldering (not shown) to an electrically-conductive film 43 in the groove 42. Reference numeral 44 denotes a body, and reference numeral 45 denotes a through hole.

Figure 15:
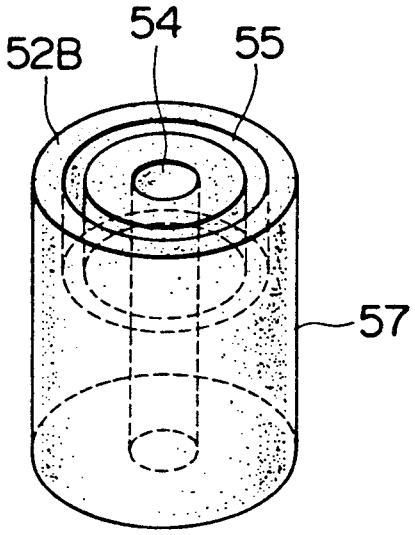
FIGS. 15 and 16 are a perspective view and a cross-sectional view of a dielectric resonator of the invention, showing a method of producing the same.
Figure 16:
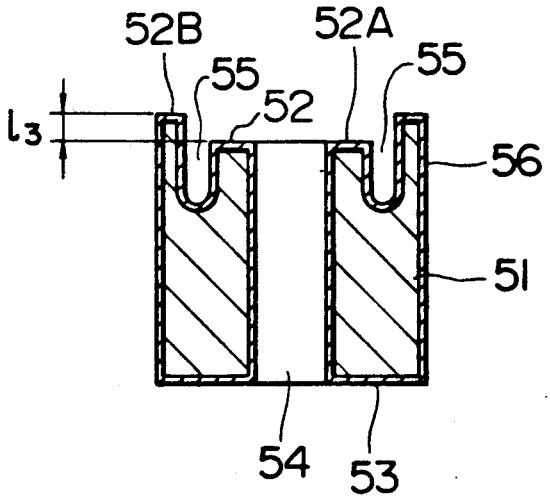
Figure 17:
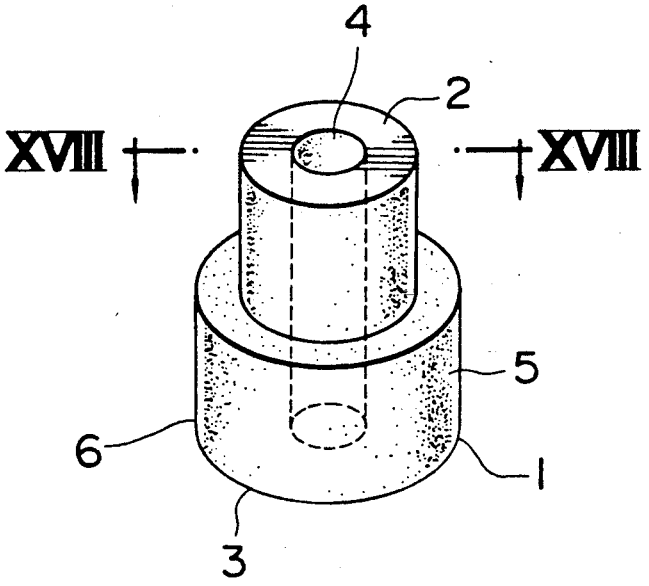
FIG. 17 PRIOR ART
FIG. 17 is a perspective view of a conventional dielectric resonator.
Figure 18:
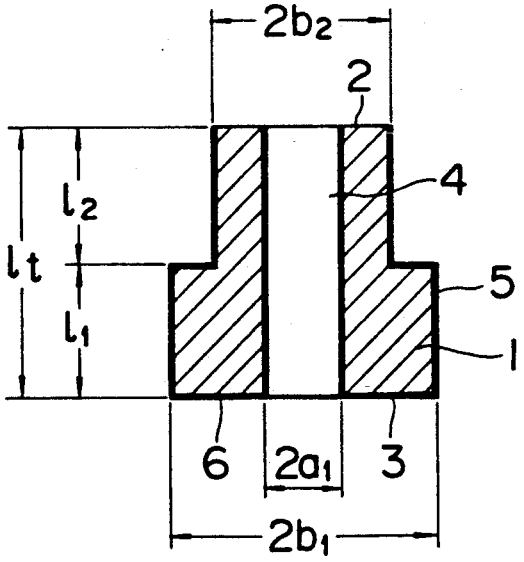
FIG. 18 PRIOR ART
FIG. 18 is a cross-sectional view taken along the line XVIII—XVIII of FIG. 17.

FIGS. 15 and 16 show one example of method of producing a dielectric resonator. First, a body 51 of a cylindrical shape is molded using a mold. As best shown in FIG. 16, the thus molded body 51 has a through hole 54 extending from an upper surface 52 to a lower surface 53 along the axis thereof, and an annular groove 55 formed in the upper surface 52 in surrounding relation to the through hole 54.

That portion 52A of the upper surface 52 lying between the through hole 54 and the groove 55 is lower in height than that portion 52B of the upper surface 52 lying between the groove 55 and the outer periphery of the body 51.

The body 51 of the above shape is baked, and then is dipped in a plating bath so as to form an electrically-conductive film 56 on the entire surface of the body 51, as shown in FIG. 16. Then, the surface of the higher surface portion 52B is removed so as to form a surface **52*b* having no electrically-conductive film 56, as shown in FIG. 15. Thus, the dielectric resonator 57** can be easily produced.

As described above, in the present invention, the groove is formed in the upper surface of the resonator body in surrounding relation to the through hole, and the inner surface of the groove is coated with the electrically-conductive film. The electrically-conductive film in the groove is electrically connected to the electrically-conductive film on the inner peripheral surface of the through hole via the electrically-conductive film formed on that portion of the upper surface of the body lying between the groove and the through hole.

With this construction, the electrically-conductive film in the through hole is extended to the electrically-conductive film formed on the upper surface of the body and the inner surface of the groove. In this case, the electrically-conductive film is formed on the bottom surface of the groove and the opposed upstanding side walls of the groove interconnected by this bottom surface, and therefore the electrically-conductive film can be made longer than that formed on the stepped outer peripheral surface of the body of the conventional dielectric resonator. Accordingly, the body of the dielectric resonator of the present invention can be made shorter.

The groove does not need to have a large width, and therefore the volume of the body is not decreased so much, so that the reduction of the selectivity of the no-load can be restrained.

What is claimed is:

1. A dielectric resonator comprising:

a dielectric body having a through hole extending therethrough from an upper and a lower surface of said body, said body having a groove formed in said upper surface of said body adjacent to an outer periphery of said through hole;

a first electrically-conductive film formed on an outer peripheral surface of said body, said lower surface of said body and an inner peripheral surface of said through hole;

a second electrically-conductive film formed on an inner surface of said groove; and a third electrically-conductive film formed on a portion of said upper surface of said body lying between said through hole and said groove, said first electrically-conductive film being electrically connected to said second electrically-conductive film by said third electrically-conductive film.

2. A dielectric resonator according to claim 1, in which a bottom surface of said groove is concavely curved.

3. A dielectric resonator according to claim 1, in which an inner side surface of said groove disposed close to said through hole is inclined upwardly toward said through hole.

4. A dielectric resonator according to claim 2, in which an inner side surface of said groove disposed close to said through hole is inclined upwardly toward said through hole.

5. A dielectric resonator according to claim 1, in which part of a lead terminal is inserted in said groove.

6. A dielectric resonator according to claim 1, in which a depth of said groove is 20% to 30% of a height of said body.

7. A filter device comprising said dielectric resonator as claimed in claim 1, and an input terminal and an output terminal each connected to said dielectric resonator via a coupling capacitor.

8. A dielectric resonator comprising:

a dielectric body having a through hole extending therethrough form an upper and a lower surface of said body, said body having an annular groove formed in said upper surface of said body in surrounding relation to said through hole;

a first electrically-conductive film formed on an outer peripheral surface of said body, said lower surface of said body and an inner peripheral surface of said through hole;

a second electrically-conductive film formed on an inner surface of said groove; and a third electrically-conductive film formed on a portion of said upper surface of said body lying between said through hole and said groove, said first electrically-conductive film being electrically connected to said second electrically-conductive film by said third electrically-conductive film.

9. A dielectric resonator according to claim 8, in which a bottom surface of said groove is concavely curved.

10. A dielectric resonator according to claim 8, in which an inner side surface of said groove disposed close to said through hole is inclined upwardly toward said through hole.

11. A dielectric resonator according to claim 9, in which an inner side surface of said groove disposed close to said through hole is inclined upwardly toward said through hole.

12. A dielectric resonator according to claim 8, in which part of a leader terminal is inserted in said groove.

13. A dielectric resonator according to claim 8, in which a depth of said groove is 20% to 30% of a height of said body.

14. A filter device comprising said dielectric resonator as claimed in claim 8, and an input terminal and an output terminal each connected to said dielectric resonator via a coupling capacitor.

15. A dielectric filter comprising:

a dielectric body having a plurality of through holes extending therethrough from an upper and a lower surface of said body, said body having a plurality of grooves which are formed in said upper surface of said body and are disposed adjacent respectively to outer peripheries of said plurality of through holes;

a first electrically-conductive film formed on an outer peripheral surface of said body, said lower surface of said body and inner peripheral surfaces of said plurality of through holes;

second electrically-conductive films formed respectively on inner surfaces of said plurality of grooves; and third electrically-conductive films formed respectively on those portions of said upper surface of said body each lying between a respective one of said through holes and a corresponding one of said grooves disposed adjacent thereto, said first electrically-conductive film being electrically connected to each of said second electrically-conductive films by a respective one of said third electrically-conductive films.

16. A dielectric resonator according to claim 15, in which a bottom surface of each of said grooves is concavely curved.

17. A dielectric resonator according to claim 15, in which an inner side surface of each of said grooves disposed close to a corresponding one of said through holes is inclined upwardly toward said through hole.

18. A dielectric resonator according to claim 16, in which an inner side surface of each of said grooves disposed close to a corresponding one of said through holes is inclined upwardly toward said through hole.

19. A dielectric resonator according to claim 15, in which part of a lead terminal is inserted in each of said grooves.

20. A method of producing a dielectric resonator, comprising the steps of:

preparing a dielectric body of a columnar shape having a through hole extending therethrough from an upper and a lower surface of said body, said body having a groove formed in said upper surface of said body adjacent to an outer periphery of said through hole, and a portion of said upper surface of said body lying between said through hole and said groove being lower in height than a portion of said upper surface of said body disposed outwardly of said groove;

subsequently forming an electrically-conductive film on an entire surface of said body; and subsequently removing said portion of said upper surface of said body disposed outwardly of said groove.

* * * * *